United States Patent [19]

Behler et al.

[11] Patent Number: 5,002,683

[45] Date of Patent: Mar. 26, 1991

[54] USE OF MIXTURES CONTAINING (A) ALKALI, AMMONIUM AND/OR AMINE SALTS OF SULFONATED UNSATURATED FATTY ACIDS AND (B) ALKOXYLATED ALKYL AND/OR ALKENYL ALCOHOLS AND/OR SULFOSUCCINIC ACID ESTERS AS WETTING AGENTS

[75] Inventors: Ansgar Behler, Bottrop; Wahle Bernd, Kaarst; Faize Selen, Duesseldorf, all of Fed. Rep. of Germany

[73] Assignee: Henkel Kommanditgesellschaft auf Aktien, Duesseldorf, Fed. Rep. of Germany

[21] Appl. No.: 396,413

[22] Filed: Aug. 18, 1989

[30] Foreign Application Priority Data

Aug. 19, 1988 [DE] Fed. Rep. of Germany ..... 3828226

[51] Int. Cl.[5] ..... C11D 5/00; D06L 3/00

[52] U.S. Cl. ..... 252/104; 252/98; 252/103

[58] Field of Search ..... 8/107, 111; 252/186.26, 252/186.29, 186.38, 186.41, 186.27, 186.28, 186.31, 196.41, 156, 526, 527, 535, 539, 524, 353

[56] References Cited

U.S. PATENT DOCUMENTS 4,106,901 8/1978 Bishop et al. ..... 8/139
4,725,281 2/1988 Stehlin et al. ..... 8/107

FOREIGN PATENT DOCUMENTS 1278421 6/1972 United Kingdom .

OTHER PUBLICATIONS

Encyclopedia of Chem. Techn. 22, 28 et seq. (1983); Chem. Techn. vol. 7, pp. 131-132 (1986); Ullmann's Encyc. der Techn. Chemie, vol. 22, pp. 482-483 (1982).

*Primary Examiner*—Paul Lieberman
*Assistant Examiner*—John F. McNally
*Attorney, Agent, or Firm*—Ernest G. Szoke; Wayne C. Jaeschke; Real J. Grandmaison

[57] ABSTRACT

The invention relates to the use of mixtures containing (A) alkali metal, ammonium and/or amine salts of sulfonated unsaturated fatty acids and (B) alkoxylated alkyl and/or alkenyl alcohols and/or sulfosuccinic acid alkyl esters as wetting agents.

20 Claims, No Drawings

USE OF MIXTURES CONTAINING (A) ALKALI, AMMONIUM AND/OR AMINE SALTS OF SULFONATED UNSATURATED FATTY ACIDS AND (B) ALKOXYLATED ALKYL AND/OR ALKENYL ALCOHOLS AND/OR SULFOSUCCINIC ACID ESTERS AS WETTING AGENTS

BACKGROUND OF THE INVENTION

1. Field of the Invention

This invention relates to the use of mixtures containing (A) alkali, ammonium and/or amine salts of sulfonated unsaturated fatty acids and (B) alkoxylated alkyl and/or alkenyl alcohols and/or sulfosuccinic acid esters as wetting agents in aqueous alkaline treatment preparations for sheet-form textiles.

2. Discussion of Related Art

Aqueous treatment preparations for the pretreatment and bleaching of natural fibers such as cotton, or mixtures of natural and synthetic fibers such as cotton/-polyester or cotton/polyamide, require the addition of wetting agents to establish faster and more intimate contact between the treatment preparation and the textile material. Mercerising liquors, bleaches, cleaning preparations, boil-off aids and degreasing preparations are examples of pretreatment and bleaching preparations. Wetting agents in treatment preparations such as these have to be water-soluble and alkali-stable and have to guarantee uniform wetting of the textile. In addition, they have to be able to be conveniently added to the treatment preparations, i.e. have to be liquid at room temperature. In addition, wetting agents are required to be environmentally acceptable, i.e. they have to be readily biodegradable with no toxic effects on water organisms.

Accordingly, the problem addressed by the present invention is to provide liquid, water-soluble, alkali-stable and readily biodegradable wetting agents which may be used in alkaline treatment preparations for sheet-form textiles.

DESCRIPTION OF THE INVENTION

Other than in the operating examples, or where otherwise indicated, all numbers expressing quantities of ingredients or reaction conditions used herein are to be understood as modified in all instances by the term "about."

The invention is based on the surprising discovery that mixtures containing A) alkali metal, ammonium and/or amine salts of sulfonated unsaturated fatty acids and (B) alkoxylated alkyl and/or alkenyl alcohols and-/or sulfosuccinic acid mono- and/or dialkyl esters in certain ratios by weight of A to B substantially satisfy the stringent demands imposed on wetting agents in alkaline treatment preparations.

Accordingly, the present invention relates to the use of mixtures containing (A) alkali metal, ammonium and/or amine salts of sulfonated unsaturated $C_{12-22}$ fatty acids, and (B) alkoxylated alkyl and/or alkenyl alcohols corresponding to the following general formula $$R\text{———}(OC_nH_{2n})_x\text{———}OH$$

in which R is a linear or branched $C_{6-22}$ alkyl or alkenyl radical, n is a number of 2 to 4 and x is a number of 2 to 10, and/or sulfosuccinic acid mono-and/or dialkyl esters containing 4 to 22 carbon atoms in the alkyl groups in the form of their alkali metal salts, in a ratio by weight of A to B of from 11:1 to 1:11 as wetting agents in alkaline bleaching liquors, mercerizing liquors, alkaline boil-off aids and degreasing preparations, desizing processes and/or for improving liquor uptake in dyeing processes for sheet-form textiles.

Mixtures in which the ratio by weight of A to B is from 8:2 to 2:8 are preferably used as wetting agents.

Alkali metal, ammonium and/or amine salts of sulfonated, unsaturated $C_{12-22}$ fatty acids may be obtained by known methods. The starting materials used for their production are mono- and/or polyunsaturated $C_{12-22}$ fatty acids, for example, dodecenoic acid, tetradecenoic acid, palmitoleic acid, petroselic acid, oleic acid, elaidic acid, linoleic acid, linolenic acid, erucic acid or mixtures of these fatty acids. Mono- or polyunsaturated $C_{16-22}$ fatty acids, for example, palmitoleic acid, oleic acid, elaidic acid, linoleic acid, linolenic acid, erucic acid or mixtures of these unsaturated fatty acids are preferably used. Unsaturated fatty acids may be sulfonated with sulfuric acid, oleum, chlorosulfonic acid or $SO_3$-containing gas mixtures. However, sulfonation is best carried out in accordance with Great Britain Patent 1,278,421 using gas mixtures of $SO_3$ and air or inert gases, for example nitrogen, in which the $SO_3$ content is between 1 and 15% by volume, at temperatures in the range from 20° to 60° C. The $SO_3$ is used in a quantity of 0.3 to 1.3 mol per double bond.

The sulfonation reactions may be carried out continuously or discontinuously in standard reactors, for example of the falling film type, typically used and suitable for the sulfatization of fatty alcohols or for the sulfonation of fatty acid esters (cf. for example Kirk-Othmer: Encyclopedia of Chemical Technology 22, 28 et seq (1983)).

On completion of sulfonation, the reaction mixture is hydrolyzed with alkalis, for example NaOH, KOH, $Na_2CO_3$, ammonia and/or ethanolamines, in the form of aqueous solutions. The quantity of alkali used is gauged in such a way that the end product has a pH value of or above 7.

The alkoxylated alkyl and/or alkenyl alcohols present in the mixtures to be used in accordance with the invention are prepared by alkoxylation of linear and/or branched alkyl and/or alkenyl alcohols of natural and-/or synthetic origin with ethylene oxide, propylene oxide and/or butylene oxide using known industrial processes (cf. for example "Chemische Technologie" Vol. 7, pages 131–132, Carl-Hanser-Verlag, München-Wien (1986)). Alkyl and/or alkenyl alcohols are preferably reacted with ethylene oxide and/or propylene oxide. The average degree of alkoxylation x of the resulting mixtures of homologous alkoxylates, which corresponds to the molar quantity of alkylene oxides added on, is between 2 and 10 and preferably between 2 and 6. Suitable linear and/or branched alkyl and/or alkenyl alcohols containing 6 to 22 carbon atoms are, for example, hexanol, octanol, octenol, decanol, dodecanol, dodecenol, tridecanol, cetyl alcohol, stearyl alcohol, oleyl alcohol, behenyl alcohol or mixtures of these alcohols. Alkyl alcohols containing 8 to 18 carbon atoms, for example octanol, decanol, dodecanol, tridecanol, cetyl alcohol, stearyl alcohol, or mixtures of these alcohols are preferred.

Decanol containing 2.9 mol ethylene oxide (EO), isotridecyl alcohol containing 5.5 mol EO and/or isotridecyl alcohol containing 6 mol EO are examples of preferred alkoxylated alkyl alcohols.

The sulfosuccinic acid mono- and/or dialkyl esters are also prepared in known manner by esterification of maleic anhydride with saturated and/or unsaturated, optionally alkoxylated $C_{4-22}$ alcohols of natural and/or synthetic origin, and subsequent reaction of the maleic acid mono- and/or dialkyl esters obtained with alkali metal hydrogen sulfites, preferably with sodium hydrogen sulfite (cf. "Ullmanns Encyclopädie der technischen Chemie", Vol 22, pages 482–483, Verlag Chemie (1982)). Butanol, hexanol, isóoctanol, $C_{12-18}$ coconut oil fatty alcohol, $C_{16-18}$ tallow fatty alcohol and/or $C_{16-18}$ tallow fatty alcohol containing 2 to 3 mol ethylene oxide are examples of alcohols used for the esterification of maleic anhydride.

The mixtures used as wetting agents in accordance with the invention, containing A) alkali metal, ammonium and/or amine salts of sulfonated unsaturated fatty acids and (B) alkoxylated alkyl and/or alkenyl alcohols and/or sulfosuccinic acid mono- and/or dialkyl esters, are produced by mixing them at temperatures in the range from 18° to 25° C. Any ratio by weight of alkoxylated alkyl and/or alkenyl alcohols to sulfosuccinic acid mono- and/or dialkyl esters may be employed.

The mixtures are light yellow to light brown, clear, aqueous, neutral to alkaline solutions which, if desired, may be bleached in known manner with hydrogen peroxide solutions or alkali metal hypochlorite solutions (chlorine bleach) at temperatures in the range from 40° to 55° C. It is advisable to incorporate preservatives known from the prior art, for example p-hydroxybenzoate and/or sorbic acid, to stabilize the mixtures against bacterial attack. The active substance content (AS) of the mixtures to be used as wetting agents in accordance with the invention in the solutions is between 20 to 90% by weight.

The liquid mixtures to be used in accordance with the invention, which may readily be incorporated in pretreatment and bleaching preparations for textile materials containing natural fibers, are distinguished by good wetting properties combined with high alkali metal stability. The mixtures may be used in alkaline cold bleaches, hot bleach liquors, mercerising liquors, alkaline boil-off aids and degreasing preparations, desizing processes and/or for improving liquor uptake in dyeing processes. However, they are preferably used in aqueous alkaline bleach liquors. These bleach liquors contain hydrogen peroxide or compounds which form hydrogen peroxide in aqueous solution as the bleaching agent. The pH value of these bleaches is adjusted to 10–14 with a base, for example with NaOH and/or KOH. The bleaching liquors used to bleach natural fibers, for example, cotton, or mixtures of natural and synthetic fibers, for example cotton/polyester or cotton/polyamide, contain per liter 10 to 100 ml of 35% by weight hydrogen peroxide, 5 to 20 g of a base selected from the group consisting of sodium hydroxide and/or potassium hydroxide, 5 to 50 ml of a stabilizer, for example sodium and/or potassium silicate solutions (40° Bé), ethylene diamine tetraacetic acid in the form of its salts and/or polyphosphates, 0.1 to 1.0 g of a magnesium salt, for example magnesium sulfate, 0.5 to 10 g of a sequestering agent, for example Securon ® 540, a product of Henkel KGaA, and 1 to 30 g, based on active substance, of the wetting agent mixtures to be used in accordance with the invention. The sheet-form textiles are bleached at temperatures in the range from 15° to 90° C., and preferably at a temperature of approximately 20° C. (cold bleaching).

EXAMPLES

AS = Active substance

1. Preparation of oleic acid sulfonate, dipotassium salt

Technical grade oleic acid (Edenor ® $TiO_5$, a product of Henkel KGaA) was reacted with an equimolar quantity of $SO_3$ diluted with air ($SO_3$ content = 5% by volume) in a falling film reactor at a temperature of 25° C. and the reaction product subsequently neutralized with aqueous potassium hydroxide and hydrolyzed. The product had the following characteristics:

Anionic surfactant (DGF-H-III-10): 39% by weight

Unsulfonated components (DGF-G-III-66): 4.0% by weight pH value: 8

2. Preparation of mixtures of oleic acid sulfonate, dipotassium salt, and alkoxylated alkyl alcohols (a) 400 g oleic acid sulfonate, dipotassium salt, prepared in accordance with Example 1 and 300 g decanol containing 2.9 mol ethylene oxide were stirred at room temperature in a stirred vessel until a homogeneous mixture was formed.

(b) A mixture of 200 g oleic acid sulfonate, dipotassium salt, and 800 g sulfosuccinic acid diisooctyl ester, sodium salt, was prepared as in (2.a).

(c) A mixture of 400 g oleic acid sulfonate, dipotassium salt, and 600 g isotridecyl alcohol containing 6 mol ethylene oxide was prepared as in (2.a).

3. Determination of wetting power (a) Wetting power was determined in accordance with DIN 53 901 in the neutral range and in aqueous sodium hydroxide solution at 20° C. and 60° C. In every case, the quantity of wetting agent was 1 g AS/l. The results are shown in Table 1.

TABLE 1

| Wetting agent | Neutral 20° C. | Neutral 60° C. | Sodium hydroxide 1.2% by weight 20° C. | Sodium hydroxide 1.2% by weight 60° C. | Content 4% by weight 20° C. | Content 4% by weight 60° C. |
|---|---|---|---|---|---|---|
| | (In seconds) | | | | | |
| Example 2a | 90 | 100 | 65 | 90 | 100 | 150 |
| Example 2b | 10 | 22 | 87 | 344 | 370 | 296 |
| Example 2c | 24 | 35 | 25 | 44 | 48 | 48 |
| For comparison: | | | | | | |
| Oleic acid sulfonate, dipotassium salt | >1800 | 100 | 360 | 341 | >1800 | 195 |
| Decanol × 2.9 mol ethylene oxide | 17 | 25 | 15 | 127 | 57 | 184 |
| Sulfosuccinic acid diisooctyl ester, sodium salt | 4 | 4 | 16 | >1800 | 559 | 323 |

TABLE 1-continued

| Wetting agent | Neutral 20° C. | Neutral 60° C. | Sodium hydroxide 1.2% by weight 20° C. | Sodium hydroxide 1.2% by weight 60° C. | Content 4% by weight 20° C. | Content 4% by weight 60° C. |
|---|---|---|---|---|---|---|
| | (In seconds) | | | | | |
| Isotridecyl-alcohol × 6 mol ethylene oxide | 16 | 10 | >1800 | >1800 | 60 | 500 |

(b) Wetting power was determined in accordance with DIN 53 901 in a cold bleach liquor at approximately 20° C. The cold bleach liquor contained 40 ml of 35% by weight hydrogen peroxide, 0.15 g $MgSO_4 \cdot 7H_2O$, 15 ml waterglass 38/40° Bé, 16 ml NaOH (50%), 2 g of a complexing agent (Securon ® 540, a product of Henkel KGaA) and 8 g AS wetting agent per liter of liquor. The results are shown in Table 2.

TABLE 2

| Wetting agent | Wetting power in seconds |
|---|---|
| Example 2a | 2.0 |
| Example 2b | 2.0 |
| Example 2c | 2.0 |
| For comparison: | |
| Oleic acid sulfonate, di-potassium salt | >600 |
| Decanol × 2.9 mol ethylene oxide | 3 |
| Sulfosuccinic acid diisooctyl ester, sodium salt | 47 |
| Isotridecyl alcohol × 6 mol ethylene oxide | 3 |

4. Determination of alkali metal stability (a) The alkali metal stability of various wetting agents was determined at 20° C. and at 80° C. in aqueous sodium hydroxide solution of different concentrations both immediately and after 1 hour. The results are shown in Table 3.

TABLE 3

| | | Alkali compatibility Immediately | After 1 hour |
|---|---|---|---|
| Example 2a (4.52 g AS/1) | | | |
| 7% by weight sodium hydroxide | 20° C. | cloudy, homogeneous | unchanged |
| | 80° C. | cloudy, homogeneous | inhomogeneous |
| 11.5% by weight sodium hydroxide | 20° C. | cloudy, homogeneous | slight creaming |
| | 80° C. | cloudy, homogeneous | inhomogeneous |
| 17% by weight sodium hydroxide | 20° C. | cloudy, homogeneous | slight creaming |
| | 80° C. | cloudy, homogeneous | inhomogeneous |
| Example 2b (4.52 g AS/1) | | | |
| 7% by weight sodium hydroxide | 20° C. | cloudy, homogeneous | cloudy |
| | 80° C. | cloudy, homogeneous | cloudy |
| 11.5% by weight sodium hydroxide | 20° C. | cloudy, homogeneous | cloudy |
| | 80° C. | cloudy, homogeneous | cloudy |
| 17% by weight sodium hydroxide | 20° C. | cloudy, homogeneous | cloudy |
| | 80° C. | cloudy, homogeneous | cloudy |
| Example 2c (4.52 g AS/1) | | | |
| 7% by weight sodium hydroxide | 20° C. | clear | clear |
| | 80° C. | clear | clear |
| 11.5% by weight sodium hydroxide | 20° C. | clear | clear |
| | 80° C. | clear | clear |
| 17% by weight sodium hydroxide | 20° C. | clear | clear |
| | 80° C. | clear | clear |
| For comparison: | | | |
| Oleic acid sulfonate, dipotassium salt (4.52 g AS/1) | | | |
| 7% by weight sodium hydroxide | 20° C. | clear | clear |
| | 80° C. | clear | clear |
| 11.5% by weight sodium hydroxide | 20° C. | clear | clear |
| | 80° C. | clear | clear |
| 17% by weight sodium hydroxide | 20° C. | clear | clear |
| | 80° C. | clear | clear |
| Decanol × 2.9 mol ethylene oxide (4.52 g AS/1) | | | |
| 7% by weight sodium hydroxide | 20° C. | cloudy | sediment |
| | 80° C. | inhomogeneous | inhomogeneous |
| 11.5% by weight sodium hydroxide | 20° C. | inhomogeneous | inhomogeneous |
| | 80° C. | inhomogeneous | inhomogeneous |
| 17% by weight sodium hydroxide | 20° C. | inhomogeneous | inhomogeneous |
| | 80° C. | inhomogeneous | inhomogeneous |
| Sulfosuccinic acid diisooctyl ester, sodium salt | | | |

TABLE 3-continued

| | Alkali compatibility | | |
|---|---|---|---|
| | | Immediately | After 1 hour |
| (4.52 g AS/1) | | | |
| 7% by weight sodium hydroxide | 20° C. | slight creaming | inhomogeneous |
| | 80° C. | cloudy | inhomogeneous |
| 11.5% by weight sodium hydroxide | 20° C. | inhomogeneous | inhomogeneous |
| | 80° C. | inhomogeneous | inhomogeneous |
| 17% by weight sodium hydroxide | 20° C. | inhomogeneous | inhomogeneous |
| | 80° C. | inhomogeneous | inhomogeneous |
| Isotridecyl alcohol × 6 mol ethylene oxide (4.52 g AS/1) | | | |
| 7% by weight sodium hydroxide | 20° C. | inhomogeneous | inhomogeneous |
| | 80° C. | inhomogeneous | inhomogeneous |
| 11.5% by weight sodium hydroxide | 20° C. | inhomogeneous | inhomogeneous |
| | 80° C. | inhomogeneous | inhomogeneous |
| 17% by weight sodium hydroxide | 20° C. | inhomogeneous | inhomogeneous |
| | 80° C. | inhomogeneous | inhomogeneous |

(b) Alkali metal stability was determined in a cold bleaching liquor immediately, after 1 hour and after 24 hours. The composition of the cold bleaching liquor corresponded to the composition in (3b). The results are shown in Table 4.

TABLE 4

| Wetting agent (Quantity used per 1 liquor: 8.0 g AS) | Alkali metal stability of Liquor A | | | Liquor B | | |
|---|---|---|---|---|---|---|
| | Immediately | After 1 h | After 24 h | Immediately | After 1 h | After 24 h |
| Example 2a | + | + | + | + | + | + |
| Example 2b | + | + | + | + | + | + |
| Example 2c | + | + | + | + | + | + |
| For comparison: | | | | | | |
| Oleic acid sulfonate, di-potassium salt | + | + | + | + | + | + |
| Decanol × 2.9 mol ethylene oxide | X | – | – | X | – | – |
| Sulfosuccinic acid diisooctyl ester, sodium salt | X | – | – | – | – | – |
| Isotridecyl alcohol × 6 mol ethylene oxide | X | – | – | – | – | – |

Liquor B is 7 times stronger than liquor A.
+ = no separation, homogeneous;
X = incipient separation;
– = separation

We claim:

1. A wetting agent mixture for use in alkaline bleaching liquors, mercerizing liquors, alkaline boil-off aids and degreasing preparations, desizing processes or for improving liquor uptake in dyeing processes for sheet-form textiles, said mixture consisting of (A) an alkali metal, ammonium or amine salt of a sulfonated unsaturated $C_{12-22}$ fatty acid, and (B) an alkoxylated alkyl or alkenyl alcohol corresponding to the following formula $$R\text{———}(OC_nH_{2n})_x\text{———}OH$$

in which R seleted from the group consisting of is a linear or branched $C_{6-22}$ alkyl or alkenyl radical, n is an number of 2 to 4 and x is a number of about 2 to about 10, a sulfosuccinic acid mono- or dialkyl ester containing 4 to 22 carbon atoms in the alkyl groups in the form of their alkali metal salts and mixtures thereof in a ratio by weight of A to B of from about 11:1 to about 1:11.

2. A wetting agent mixture as in claim 1 wherein said ratio by weight of A to B is from about 8:2 to about 2:8.

3. A wetting agent mixture as in claim 1 wherein said sulfonated fatty acid comprises a $C_{16}$–$C_{22}$ fatty acid.

4. A wetting agent mixture as in claim 1 wherein in said formula, R is a linear or branched $C_{8-18}$ alkyl radical, n is 2 or 3 and x is a number of about 2 to about 6.

5. A wetting agent mixture as in claim 1 wherein said alkoxylated alkyl alcohol is selected from decanol containing about 2.9 mol of ethylene oxide, isotridecyl alcohol containing about 5.5 mol of ethylene oxide, and isotridecyl alcohol containing about 6 mol of ethylene oxide.

6. An alkaline bleaching liquor consisting essentially of, per liter of said liquor, from about 10 to about 100 ml of 35% by weight hydrogen peroxide, from about 5 to about 20 grams of sodium hydroxide or potassium hydroxide, from about 5 to about 50 ml of a stabilizer, from about 0.1 to about 1.0 gram of a magnesium salt, from about 0.5 to about 10 grams of a sequestering agent, and from about 1 to about 30 grams, based on active substance of a wetting agent mixture consisting essentially of (A) an alkali metal, ammonium or amine salt of a sulfonated unsaturated $C_{12-22}$ fatty acid, and (B) an alkoxylated alkyl or alkenyl alcohol corresponding to the following formula $$R\text{——}(OH_nH_{2n})_x\text{——}OH$$

in which R is selected from the group consisting of a linear or branched $C_{6-22}$ alkyl or alkenyl radical, n is a number of 2 to 4 and x is a number of about 2 to about 10, a sulfosuccinic acid mono- or dialkyl ester containing 4 to 22 carbon atoms in the alkyl groups in the form of their alkali metal salts and mixtures thereof in a ratio by weight of A to B of from about 11:1 to about 1:11.

7. An alkaline bleaching liquor as in claim 6 wherein said ratio by weight of A to B is from about 8:2 to about 2:8.

8. An alkaline bleaching liquor as in claim 6 wherein said sulfonated unsaturated fatty acid comprises a $C_{16}$–$C_{22}$ fatty acid.

9. An alkaline bleaching liquor as in claim 6 wherein in said formula, R is a linear or branched $C_{8-18}$ alkyl radical, n is 2 or 3 and x is a number of about 2 to about 6.

10. An alkaline bleaching liquor as in claim 6 wherein said alkoxylated alkyl alcohol is selected from decanol containing about 2.9 mol of ethylene oxide, isotridecyl alcohol containing about 5.5 mol of ethylene oxide, and isotridecyl alcohol containing about 6 mol of ethylene oxide.

11. The process of treating sheet-form textiles consisting essentially of contacting said textiles with a wetting agent mixture consisting essentially of (A) an alkali metal, ammonium or amine salt of a sulfonated unsaturated $C_{12-22}$ fatty acid, and (B) an alkoxylated alkyl or alkenyl alcohol corresponding to the following formula $$R\text{——}(OC_nH_{2n})_x\text{——}OH$$

in which R seleted from the group consisting of is a linear or branched $C_{6-22}$ alkyl alkenyl radical, n is a number of 2 to 4 and x is a number of about 2 to about 10, or a sulfosuccinic acid mono- or dialkyl ester containing 4 to 22 carbon atoms in the alkyl groups in the form of their alkali metal salts and mixtures thereof in a ratio by weight of A to B of from about 11:1 to about 1:11.

12. The process as in claim 11 wherein said ratio by weight of A to B is from about 8:2 to about 2:8.

13. The process as in claim 11 wherein said sulfonated unsaturated fatty acid comprises a $C_{16-22}$ fatty acid.

14. The process as in claim 11 wherein in said formula, R seleted from the group consisting of is a linear or branched $C_{8-18}$ alkyl radical, n is 2 or 3 and x is a number of about 2 to about 6.

15. The process as in claim 11 wherein said alkoxylated alkyl alcohol is selected from decanol containing about 2.9 mol of ethylene oxide, isotridecyl alcohol containing about 5.5 mol of ethylene oxide, and isotridecyl alcohol containing about 6 mol of ethylene oxide.

16. The process of treating sheet-form textiles, consisting essentially of contacting said textiles with an alkaline bleaching liquor consisting essentially of, per liter of said liquor, from about 10 to about 100 ml of 35% by weight hydrogen peroxide, from about 5 to about 20 grams of sodium hydroxide or potassium hydroxide, from about 5 to about 50 ml of a stabilizer, from about 0.1 to about 1.0 gram of a magnesium salt, from about 0.5 to about 10 grams of a sequestering agent, and from about 1 to about 30 grams, based on active substance, of a wetting agent mixture consisting essentially of (A) an alkali metal ammonium or amine salt of a sulfonated unsaturated $C_{12-22}$ fatty acid, and (B) an alkoxylated alkyl or alkenyl alcohol corresponding to the following formula $$R\text{——}(OC_nH_{2n})_x\text{——}OH$$

in which R is a linear or branched $C_{6-22}$ alkyl or alkenyl radical, n is a number of 2 to 4 and x is a number of about 2 to about 10, a sulfosuccinic acid mono- or dialkyl ester containing 4 to 22 carbon atoms in the alkyl groups in the form of their alkali metal salts and mixtures thereof in a ratio by weight of A to B of from about 11:1 to about 1:11.

17. The process as in claim 16 wherein said ratio by weight of A to B is from about 8:2 to about 2:8.

18. The process as in claim 16 wherein said sulfonated unsaturated fatty acid comprises a $C_{16-22}$ fatty acid.

19. The process as in claim 16 wherein in said formula, R is a linear or branched $C_{8-18}$ alkyl radical, n is 2 or 3 and x is a number of about 2 to about 6.

20. The process as in claim 16 wherein said alkoxylated alkyl alcohol is selected from decanol containing about 2.9 mol of ethylene oxide, isotridecyl alcohol containing about 5.5 mol of ethylene oxide, and isotridecyl alcohol containing about 6 mol of ethylene oxide.

* * * * *

UNITED STATES PATENT AND TRADEMARK OFFICE

CERTIFICATE OF CORRECTION

PATENT NO. : 5,002,683

DATED : March 26, 1991

INVENTOR(S) : Ansgar Behler et al.

It is certified that error appears in the above-identified patent and that said Letters Patent is hereby corrected as shown below:

On the title page, at Item [75] the second inventor should read --Bernd Wahle--.

At Column 7, in claim 1, line 61, after "consisting of" delete "is".

At Column 7, in claim 1, line 63, "n is an number of 2 to 4" should read --n is a number of 2 to 4--.

At Column 9, in claim 6, line 4, "R——$(OH_nH_{2n})_x$——OH" should read --R——$(OC_nH_{2n})_x$——OH--.

At Column 9, in claim 11, line 41, after "in which R" delete "seleted" and add --is selected--.

At Column 9, in claim 11, line 41, after "from the group consisting of" delete "is".

Signed and Sealed this

Twenty-second Day of December, 1992

*Attest:*

DOUGLAS B. COMER

*Attesting Officer*

*Acting Commissioner of Patents and Trademarks*